US006821144B2

(12) United States Patent
Choy

(10) Patent No.: US 6,821,144 B2
(45) Date of Patent: Nov. 23, 2004

(54) DENSELY ARRANGED DUPLEX PROFILE CONNECTOR ASSEMBLY

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/215,313

(22) Filed: Aug. 7, 2002

(65) Prior Publication Data

US 2004/0029438 A1 Feb. 12, 2004

(51) Int. Cl.[7] ..... H01R 13/60
(52) U.S. Cl. ..... 439/541.5; 439/326
(58) Field of Search ..... 439/541.5, 326–328

(56) References Cited

U.S. PATENT DOCUMENTS 5,641,295 A * 6/1997 Koyama ..... 439/326
5,755,585 A * 5/1998 Cheng et al. ..... 439/326
5,993,234 A * 11/1999 Yodogawa ..... 439/326
6,095,827 A * 8/2000 Dutkowsky et al. ..... 439/83
6,176,737 B1 * 1/2001 Choy ..... 439/541.5
6,210,194 B1 * 4/2001 Choy ..... 439/326
6,520,802 B1 * 2/2003 Mitra ..... 439/608
6,612,867 B1 * 9/2003 Wu ..... 439/541.5

* cited by examiner

*Primary Examiner*—Michael C. Zarroli
(74) *Attorney, Agent, or Firm*—Wei Te Chung

(57) ABSTRACT

A connector assembly includes upper and lower connectors each essentially defining the basic structure of the SO DIMM connector and including an elongated main body with two latches extending forwardly at two ends thereof. The body of each of the upper and the lower connectors includes upper and lower passageways receives upper and lower contacts, respectively. The body of the upper connector is higher than that of the lower connector, and defines a recess in a front lower portion thereof to receive a rear portion of the body of the lower connector, whereby the front portion of the body of the upper connector and the rear portion of the body of the lower connector overlap each other in the vertical direction, thus result in dense arrangement of the assembly.

18 Claims, 6 Drawing Sheets

DENSELY ARRANGED DUPLEX PROFILE CONNECTOR ASSEMBLY

BACKGROUND OF THE INVENTION

1. Field of the Invention

The invention relates to stacked type connector assembly, and particularly to the two densely arranged SO DIMM (Small Outline Dual In-line Memory Module) connectors adapted for mounting to a printed circuit board.

2. The Related Art

U.S. Pat. No. 6,126,472 having the same applicant and the same assignee with the invention discloses two SO DIMM connectors stacked with each other for receiving the two modules, respectively, wherein each of connectors includes upper row and lower row contacts respectively forwardly and rearwardly inserted into and then received in the upper and lower passageways of the corresponding housing. In the recent years, as mentioned in U.S. Pat. No. 5,964,606 having the same applicant and the same assignee with the invention, miniaturization is the trend for the connector design. Accordingly, it is desired to provide dense arrangement of the stacked SO DIMM connectors or other similar stacked horizontal type connector assembly.

SUMMARY OF THE INVENTION

According to an aspect of the invention, a connector assembly includes upper and lower connectors each essentially defining the basic structure of the SO DIMM connector and including an elongated main body with two latches extending forwardly at two ends thereof. The body of each of the upper and the lower connectors includes upper and lower passageways receives upper and lower contacts, respectively. The body of the upper connector is higher than that of the lower connector, and defines a recess in a front lower portion thereof to receive a rear portion of the body of the lower connector, whereby the front portion of the body of the upper connector and the rear portion of the body of the lower connector overlap each other in the vertical direction, thus result in dense arrangement of the assembly in comparison with the prior art arrangement where the two bodies of the upper and lower connector are spaced from each other in the front-to-back direction.

Another feature of the invention optionally provides dense and even contact arrangement under the bodies of the upper and lower connectors.

Another feature of the invention optionally provides capability of rearwardly installing the lower contacts of the upper connector from the recess wherein the contact portion of the lower contact of the upper connector is substantially located above the recess in the vertical direction.

Another feature of the invention optionally provides two pairs of different type contacts in upper and lower connectors, respectively, wherein each pair of contacts do not overlap each other in a lengthwise direction of the body so as to avoid overlapping the corresponding upper and lower passageways, thus assuring strength of the body.

Another feature of the invention provides the mounting pads, which are located around the latch portion far away from the body, with optionally the solder balls, so the connector assembly will not be tilted during mounting on the printed circuit board when the BGA (Ball Grid Array as mentioned in U.S. Pat. No. 6,220,884) contacts are used in this invention.

DETAILED DESCRIPTION OF THE PREFERRED EMBODIMENTS

Figure 1:
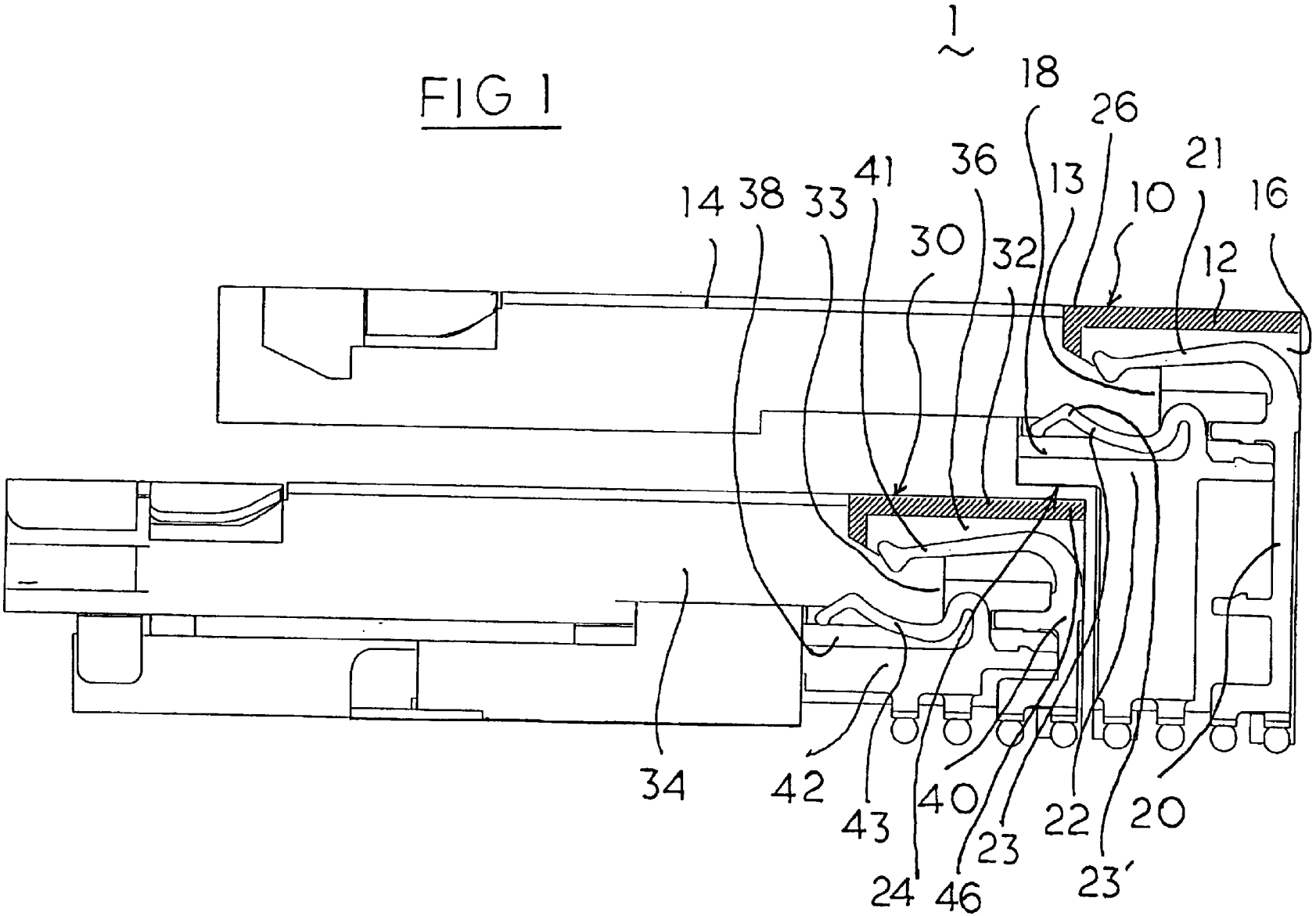
FIG. 1 shows a side view of the present preferred embodiment of the connector assembly with some portions of the housing being removed to show the relative positions of the corresponding upper and lower contacts in the upper and lower connectors.
Figure 2:
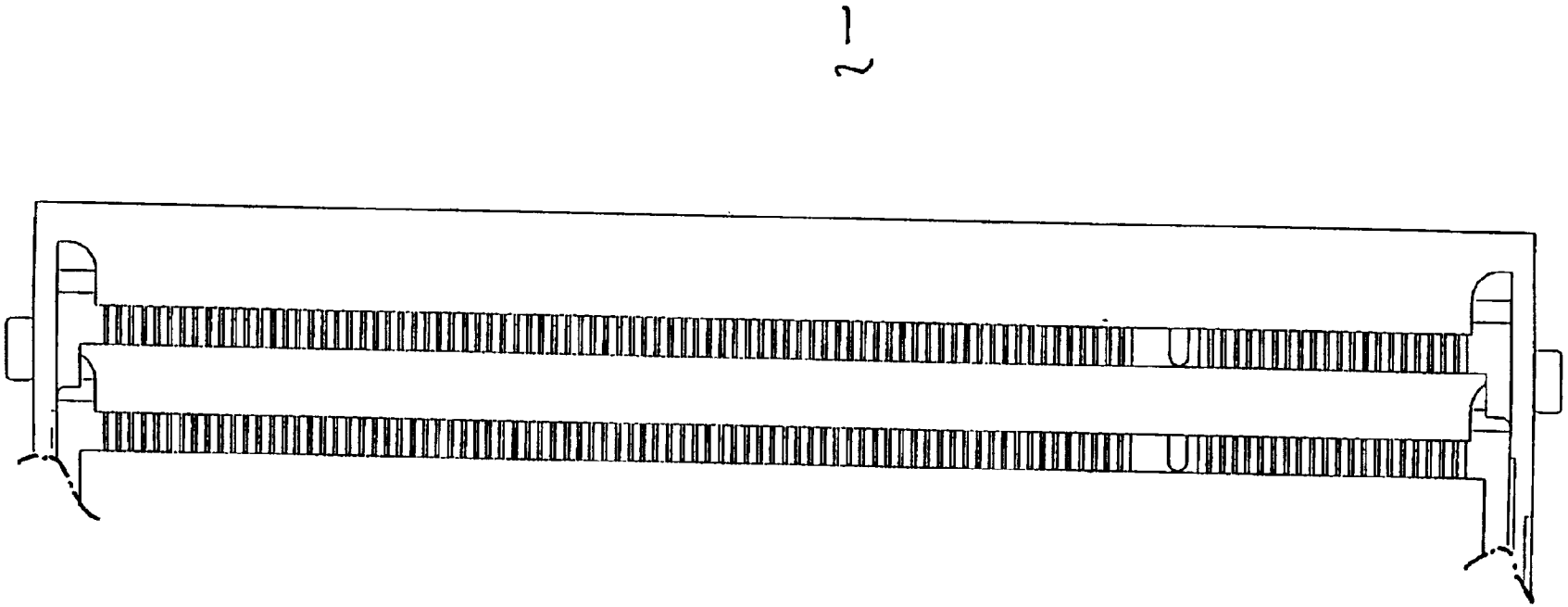
FIG. 2 shows a partial top view of the connector assembly of FIG. 1.
Figure 3:
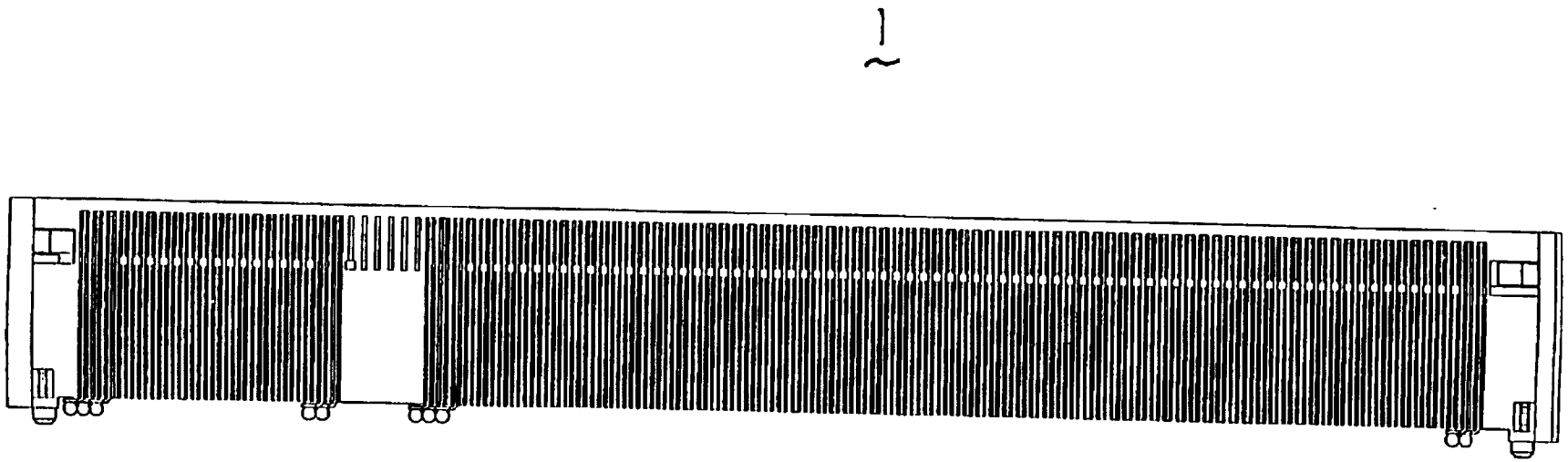
FIG. 3 shows a back elevational view of the connector assembly of FIG. 1.
Figure 4:
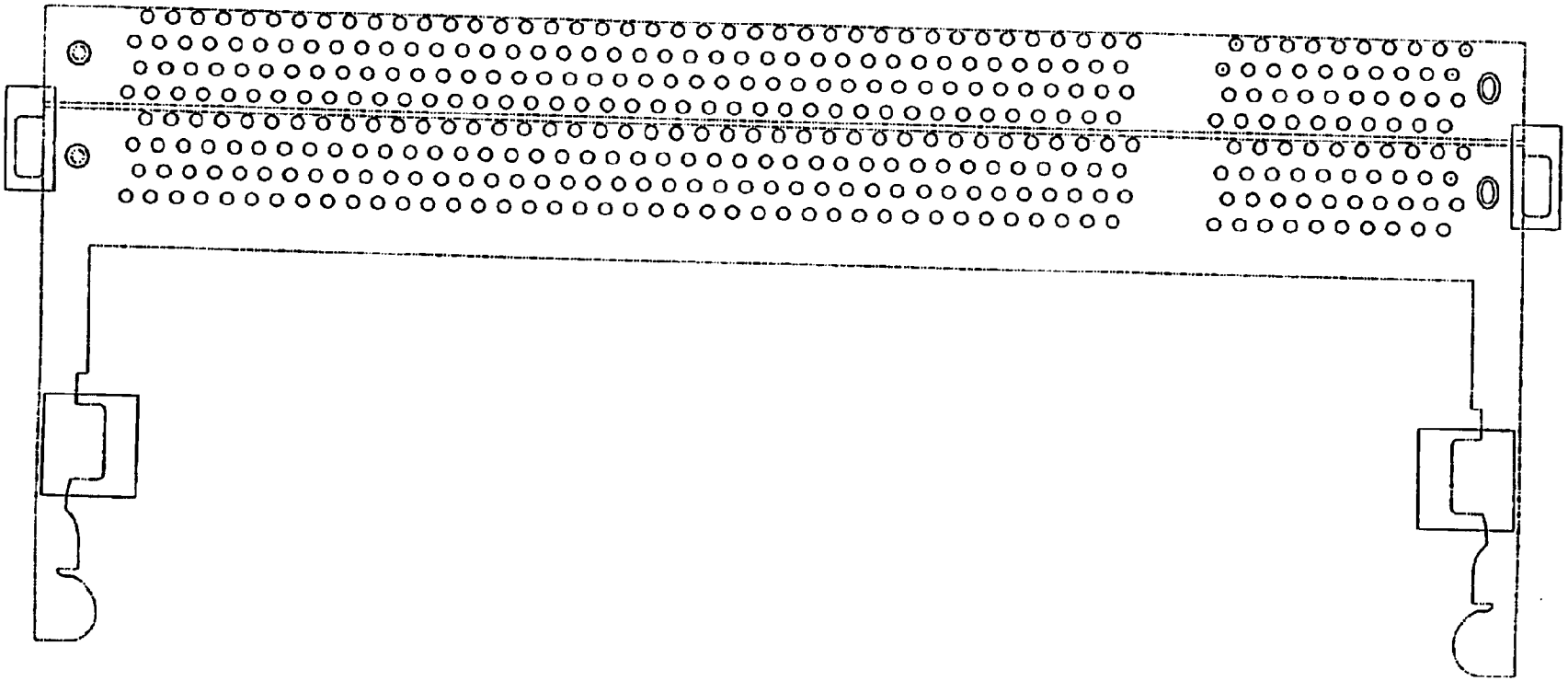
FIG. 4 shows a simulative layout of a printed circuit board on which the connector assembly is mounted.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–5 wherein the connector assembly 1 includes a lower SO DIMM connector 30 and an upper connector 10 stacked upon the lower SO DIMM connector 30. Each of said upper connector 10 and lower connector 30 includes an insulative elongated main body 12, 32 with a card receiving slot 13, 33 therein and a pair of latch sections 14, 34 extending forwardly from two opposite ends thereof.

Each body 12, 32 defines upper(rear) passageways 16, 36, and lower(front) passageways 18, 38 to respectively receive corresponding upper contacts 20, 40 and lower contacts 22, 42 wherein the upper contacts 20, 40 are forwardly inserted into the corresponding upper passageways 16, 36 from a rear portion of the body 12, 32, while the lower contacts 22, 42 are inserted into the corresponding lower passageways 18, 38 from a front portion f the body 12, 32. The contact portions 21, 41 of the upper contacts 20, 40 and the contact portions 23, 43 of the lower contacts 22, 42 respectively extend into the slot 13, 33 of the body 10, 30. It should be noted similar to what disclosed in the aforementioned U.S. Pat. No. 6,126,472 regarding SO DIMM connectors the upper passageways 16, 36 and the lower passageways 18, 38 are staggered with each other along the lengthwise direction of the body 12, 32 in a zigzag manner along the body 12, 32, and the corresponding upper and lower contacts 20, 40 and 22, 42 are respectively inwardly inserted into the corresponding passageways 16, 36 and 18, 38 from opposite rear and front faces of the body 12, 32 along two opposite directions. It is appreciated that FIG. 1 is not a real cross-sectional view of the connector assembly along any specific line while only being an illustration combined figure to show the general positions of the upper and lower contacts 18, 38, 20, 40 in the upper and lower connector 10, 30, not indicating that the upper passageways 16, 36 and/or the upper contacts 20, 40 are communicatively coplanar with the lower passageways 18, 38 and/or the lower contacts 22, 42.

One feature of the invention is to provide a cutout or notch 24 around a front lower portion of the upper connector 10 which compliantly receives a rear portion 46 of the lower connector 30 therein. Thus, the rear portion 46 of the lower connector 30 is located under the front portion 26 of the upper connector 10. Through this arrangement, the upper connector 10 and the lower connector 30 can be densely/closely arranged with each other in both the front-to-back direction and the vertical direction, thus meeting the low profile/miniaturization desire of the industry. Under this situation, the contact point 23' of the lower contact 22 of the upper connector 10 is right above the rear portion 46 of the lower connector 30 in the vertical direction.

It is seen that similar to arrangement shown in the aforementioned U.S. Pat. No. 6,126,472, in this embodiment there are essentially four type contacts used in the connector assembly while each type is further diversified with two different staggered tail sections for compliance with the layout of the printed circuit board on which the connector assembly 1 is mounted. Therefore, there are total eight tail sections 25, 45 extending downwardly from the bodies 10, 30 of the connector assembly 1. Anyhow, different from what is shown in the aforementioned U.S. Pat. No. 6,126,472, all the eight tail sections 25, 45 (FIG. 5) of both the upper and lower connectors 10, 30 are able to be evenly and densely arranged one another.

It is also noted that similar to arrangement shown in the aforementioned U.S. Pat. No. 6,126,472, the upper contacts 20, 40 and the lower contact 22, 42 are substantially not overlapped with each other along the lengthwise direction of the body 10, 30 so as to avoid overlapping of the corresponding upper and lower passageways, 18, 38 along the lengthwise direction, thus assuring the solidity of the body 10, 30.

Figure 5:
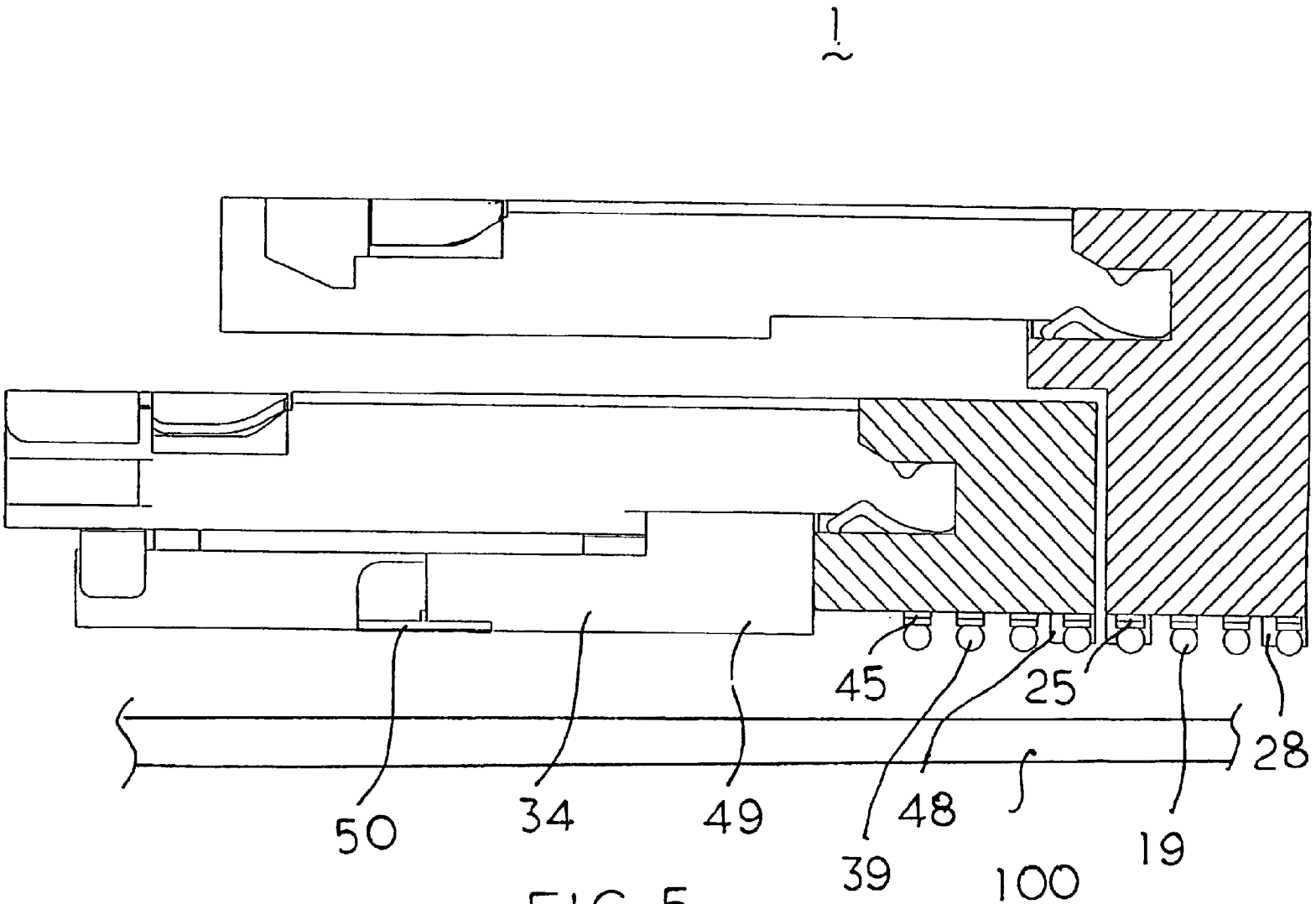
FIG. 5 shows the side cross-sectional view of the connector assembly of FIG. 1 similar to FIG., and a printed circuit board on which the lower connector is mounted

FIGS. 1 and 5 shows standoffs 28, 48 of the body 10, 30 and standoffs 49 of the latch sections 34 are located above the bottom point of the solder balls 19, 39 attached to the upper and lower contacts 20, 40, 22, 42 of the upper and lower connectors 10, 30 when the connector has not been soldered on a printed circuit board 100. Understandably, the solder balls 19, 39 will be compressed/deformed when the solder balls 19, 39 are soldered on the printed circuit board 100 via a reflow process under a condition that the standoffs 28, 48 and 49 are also seated upon the printed circuit board 100. The relation and function of standoffs and the solder balls may be referred to U.S. Pat. No. 6,152,756 and 6,220,884 having the same assignee with the invention. The latch section 34 also includes a mounting pad 50 to secure the connector assembly to the printed circuit board 100. The operation of the mounting pad 50 can be referred to U.S. Pat. No. 6,419,513 having the same applicant and the same assignee with the invention.

Figure 6:
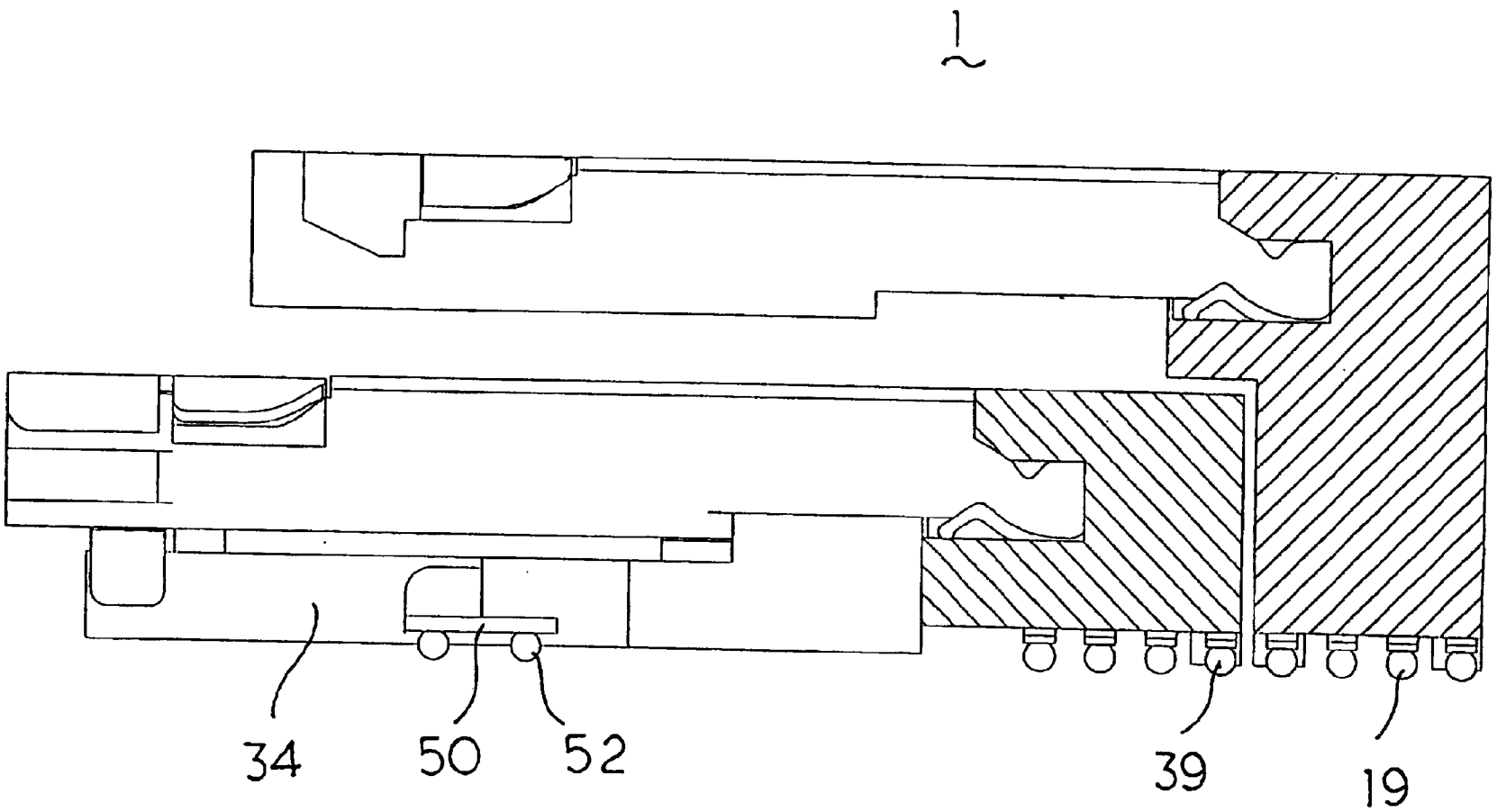
FIG. 6 shows the side cross-sectional view of the connector assembly of FIG. 1 with the BGA contacts therein and with the mounting pad equipped with solder balls.

FIG. 6 shows an alternative embodiment of the invention wherein the mounting pad 50 is equipped with the solder balls 52 having the same bottom level with the solder balls 19, 39 so that the connector assembly 1 will not be downwardly tilted to the distal end of the latch section 34 when the connector assembly 1 is put on the printed circuit board 100 while before the reflow process for soldering. With cooperation of the solder balls 19, 39 and the solder balls 52 along the front-to-back direction of the connector assembly 1, the connector assembly may be precisely and evenly soldered on the printed circuit board via a reflow process.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. For example, other horizontal type stacked connectors other than the SO DIMM connector may be applied.

Therefore, person of ordinary skill in this field are to understand that all such equivalent structures are to be included in the scope of the following claims.

I claim:

1. A connector assembly comprising:

upper and lower horizontal type connectors stacked on each other wherein the lower connector is essentially located in front of the upper connector, each of said upper and lower connectors including:

an elongated body with a plurality of upper and lower contacts therein;

a notch being formed in a front lower portion of the body of the upper connector to compliantly receive a rear portion of the body of the lower connector; wherein a front upper portion of the body of the upper connector is substantially located right above said rear portion of the body of the lower connector; wherein a front portion of each of the lower contacts of the upper connector is located right above said notch in a vertical direction so that the upper connector and the lower connector are allowed to be densely arranged with each other in a front-to-back direction.

2. The connector as described in claim 1, wherein said upper and lower contacts are staggered with each other along a lengthwise direction of the corresponding body.

3. The connector as described in claim 1, wherein each of the upper and lower connector includes a pair of latch sections extending forwardly from two opposite ends of the corresponding body, and wherein the latch section of the upper connector is positioned above those of the lower connector.

4. The connector as described in claim 1, wherein tail sections of the contacts of both the upper and lower connectors are evenly and densely arranged with one another.

5. The connector as described in claim 1, wherein the contacts are equipped with solder balls at bottom portions, respectively.

6. The connector as described in claim 1, wherein the each of the upper and lower connector includes a pair of latch sections extending forwardly from two opposite ends of the corresponding body, the latch section of the upper connector is positioned above those of the lower connector, and the latch sections of the lower connector having mounting pads equipped with solder balls.

7. The connector as described in claim 1, wherein said upper and lower connectors are SO DIMM (Small Outline Dual In-line Memory Module) connectors.

8. A lower profile densely arranged duplex connector assembly, comprising:

discrete upper and lower connectors, the upper connector including an upper elongated main body with an upper slot therein for receiving a corresponding module, and a plurality of upper and lower contacts by upper and lower sides of the upper slot; and the lower connector including a lower elongated main body with a lower slot therein for receiving a corresponding module, and a plurality of upper and lower contacts by upper and lower sides of the lower slot; wherein said upper main body is substantially located above and behind the lower connector under a condition that a front portion of the upper body is substantially right above a rear portion of the lower main body; wherein a front portion of each of the lower contacts of the upper connector is located right above a rear portion of each of the upper contacts of the lower connector in a vertical direction so that the upper connector and the lower connector are allowed to be densely arranged with each other in a front-to-back direction.

9. The connector assembly as described in claim 8, wherein the contacts of the upper connector are oppositely installed into the upper main body from rear and front faces thereof before the upper connector is located closely above and behind the lower connector.

10. The connector assembly as described in claim 8, wherein the contacts of the lower connector are oppositely installed into the lower main body from rear and front faces thereof before the upper connector is located closely above and behind the lower connector.

11. The connector assembly as described in claim 8, wherein a pair of platforms extend forwardly from two opposite ends of the main body of each of the upper and lower connectors.

12. The connector assembly as described in claim 11, wherein said pair of platforms includes means for latching a module relative to the corresponding main body.

13. The connector assembly as described in claim 11, wherein the contacts are equipped with solder balls, and the pair of platforms of the lower connector include mounting pads also equipped with solder balls thereon.

14. The connector assembly as described in claim 8, wherein the upper main body includes portions located right behind the lower main body.

15. The connector assembly as described in claim 8, wherein both said upper and lower connectors are of a horizontal type.

16. The connector assembly as described in claim 8, wherein both said upper and lower connectors receive card-like modules therein.

17. A connector assembly (1) comprising:

an elongated main body (32);

a plurality of contacts (40, 42) disposed in the main body (32);

first solder balls (39) secured to bottom portions (45) of the corresponding contacts (40, 42), respectively;

a pair of platforms (34) forwardly extending from two opposite ends of the main body (32);

a pair of mounting pads (50) respectively located on the pair of platforms (34) and spaced from the first solder balls (39); and second solder balls (52) secured to the mounting pads (50); wherein the mounting pad (50) is larger than the bottom portion (45) of the contact (40, 42), and thus carrying more solder amount of the solder balls (52) in comparison with each individual contact (40, 42).

18. The connector assembly (1) as descried in claim 17, wherein the pair of platforms (34) having latch sections thereon.

* * * * *